US006249086B1

(12) United States Patent
Honda et al.

(10) Patent No.: US 6,249,086 B1
(45) Date of Patent: Jun. 19, 2001

(54) HIGH-PRESSURE DISCHARGE LAMP INCLUDING A LIMITED AMOUNT OF CARBON REMAINING ON AN ELECTRODE SURFACE

(75) Inventors: Hisashi Honda; Seiji Ashida; Kiyoshi Saita, all of Yokosuka; Ariyoshi Ishizaki; Akira Itoh, both of Yokohama; Shigehisa Kawatsuru, Yokosuka; Tatsuo Otabe, Tokyo, all of (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 0 days.

(21) Appl. No.: 09/458,793

(22) Filed: Dec. 10, 1999

Related U.S. Application Data

(63) Continuation of application No. PCT/JP99/02014, filed on Apr. 15, 1999.

(30) Foreign Application Priority Data

Apr. 16, 1998 (JP) ..... 10-106801
Jul. 24, 1998 (JP) ..... 10-210056

(51) Int. Cl.[7] ..... H01J 17/04; H01J 1/02

(52) U.S. Cl. ..... 313/631; 313/633; 313/375; 313/352; 313/355

(58) Field of Search ..... 313/631, 632, 313/637, 638, 633, 575, 352, 354, 355, 356, 357

(56) References Cited

U.S. PATENT DOCUMENTS 560,476 * 5/1896 Coffin ..... 313/354
3,715,440 * 2/1973 Robiette ..... 313/354
5,757,130 * 5/1998 Dolan et al. ..... 313/574

FOREIGN PATENT DOCUMENTS 59-195663 12/1984 (JP) .
5-86026 12/1993 (JP) .
WO99/54906 10/1999 (WO) .

* cited by examiner

*Primary Examiner*—Nimeshkumar D. Patel
*Assistant Examiner*—Joseph Williams
(74) *Attorney, Agent, or Firm*—Christensen O'Connor Johnson Kindness PLLC

(57) ABSTRACT

A high-pressure discharge lamp which includes a light-transmitting air-tight discharge container, an electrode formed of tungsten as a main component and fixedly sealed in the discharge container, and a discharge medium containing a halide of a light emitting metal and sealed in the discharge container. The surface of the electrode is defined as follows. That is, the average value of center line average roughness Ra of the surface, is set to 0.3 $\mu$m or less, or the average value of the center line average roughness Rz of the surface of the electrode, is set to 1.0 $\mu$m or less, or the average value of the surface area increasing rate of the surface of the electrode is set to 1.0% or less.

5 Claims, 8 Drawing Sheets

HIGH-PRESSURE DISCHARGE LAMP INCLUDING A LIMITED AMOUNT OF CARBON REMAINING ON AN ELECTRODE SURFACE

CROSS REFERENCE TO RELATED APPLICATIONS

This is a continuation of application No. PCT/JP 99/02014, filed Apr. 15, 1999.

BACKGROUND OF THE INVENTION

The present invention relates to a high-pressure discharge lamp having a light-transmitting air-tight discharge container, and an illumination device which uses the lamp.

High-pressure discharge lamps (to be called "ceramic discharge lamps" hereinafter) having discharge containers (to be called "light-transmitting ceramic discharge containers" hereinafter) made of light-transmitting ceramics are superior to conventional discharge containers made of quartz glass (to be called "quartz glass discharge containers" hereinafter) in terms of the heat resisting property and anti-corrosion property, and therefore they can achieve a high luminous efficiency and a high color rendition, as well as an excellent life duration property.

Further, light-transmitting ceramic discharge containers do not entail a phenomenon of the loss of clarity, which is caused by the reaction with light-emitting metals such as dysprosium Dy and sodium Na, and therefore they are capable of suppressing depression of luminous flux, which occurs due to the above phenomenon. Therefore, the ceramic discharge lamps are superior to high-pressure discharge lamp (to be called "quartz glass discharge lamp" hereinafter) equipped with a quartz glass discharge container in terms of the luminous flux maintenance factor.

However, while the inventors of the present invention were researching and studying a ceramic discharge lamp in order to have a higher luminous flux maintenance factor, they focused on that the luminous flux maintenance factor varies greatly within 100 hours of lighting.

FIG. 11 is a graph illustrating the luminous efficiency property with respect to the lighting time of the ceramic discharge lamp in four cases including commercially available ones and test samples.

In the figure, the abscissa axis indicates the time (hr) and the ordinate axis indicates the luminous efficiency (1 m/W).

In the figure, a curve A indicates the lighting time—luminous efficiency property of the first commercially available lamp, a curve B indicates that of the second commercially available lamp, a curve C indicates that of the first test sample, and a curve D indicates that of the second test sample. All of the ceramic discharge lamps are of a 150 W·3000K type, and the light-transmitting ceramic discharge containers, electrodes, sealing structures and discharge media of these lamps are designed under substantially similar conditions.

As is clear from the figure, in all of the ceramic discharge lamps, the reduction of luminous flux is prominent within 100 hours of lighting. Further, the lowering of the luminous flux maintenance factor in this period of time becomes even several tens of %. In extreme cases, within several minutes to several hours of lighting during the aging after completion of the manufacture, the ceramic discharge container blackens, and the luminous flux maintenance factor drastically decreases.

FIG. 12 is a graph illustrating the relationship between the entire luminous efficiency and luminous flux maintenance factor of an alumina valve which is a ceramic discharge container.

In this figure, the abscissa axis indicates the overall luminous efficiency (%) of the alumina valve and the ordinate axis indicates the luminous flux maintenance factor (%).

Further, in the figure, the overall luminous transmittance of the alumina valve of the ceramic discharge lamp and the change in the luminous flux maintaining factor until 100 hours of lighting are plotted.

As is clear from the figure, there is a clear correlation between the overall transmittance and the luminous flux maintenance factor, and the decrease in the luminous flux maintenance factor is caused by the blackening of the ceramic discharge container.

Under these circumstances, the inventors of the present invention analyzed the substance which causes the blackening, and discovered that the main component was carbon. In other words, as carbon precipitates on the inner surface of the ceramic discharge container, the blackening occurs.

Next, the source of carbon was investigated, and it was found that the sources were structural members such as electrodes, the ceramic discharge container and ceramics sealing compounds, and of these, carbon remaining on the electrodes was the main factor.

Further, a research was conducted to find out if the above-described blackening was a phenomenon unique to the ceramic discharge lamp, and it was found as a result that essentially the same phenomenon occurs in the quartz glass discharge container. However, even with the same electrode, and under the same conditions, the blackening is more prominent in the ceramic discharge container as compared to the quartz glass discharge container.

Furthermore, it was found as the results of the research and studies that the concentration of the impurities including carbon remaining on the surface of the electrode, and the like, is significantly related to the roughness of the surface of the electrode. More specifically, in the electrode of a high-pressure discharge lamp, containing tungsten as the main component, a wire material formed to have a predetermined width by the wire drawing method is used in general cases. During the drawing, a type of cut, which is called dies mark, is created, and a great amount of lubricant and polishing materials such as carbon and the like, remain in the mark of the cut.

Usually, a tungsten wire material obtained by the wire drawing is subjected to the high-temperature hydrogen process and the vacuum heat process, further, if necessary, a chemical polishing process. However, in practical cases, whether or not an irregularity on the surface and impurities created due to these processes are sufficiently eliminated from the surface, is not examined so intensely.

If carbon remains on the surface of the electrode to form WC or the like, the vapor pressure increases as compared to the case of pure tungsten, and the melting point decreases. Therefore, the amount of substance of the electrode scattered while lighting markedly increases.

In some cases, a mechanically polished wire which has been subjected to a so-called barrel polishing after forming an electrode by grinding is used; however alumina is used as the polisher, and alumina easily attaches to and remains on the surface of the tungsten wire material.

Alumina attached to the electrode reacts with quartz at high temperature in the quartz glass discharge container while lighting, to create alumina silicate, thus causing whitening in the discharge container. Further, alumina reacts with tungsten on the surface of the electrode while lighting, to form tungsten aluminate. Once tungsten aluminate is formed, the vapor pressure increases more as compared to the case of pure tungsten, and the melting point decreases. Therefore, the amount of the substance for the electrode, scattered while lighting, markedly increases. Further, if there are innumerable recesses and projections in the surface of the electrode after the completion of the above-described process, electron emission characteristic from the surface of the electrode and effective work function vary from a side to side on the surface of the electrode, and therefore it is considered that it causes the blinking of discharge.

The inventors of the present invention have found that if the concentration of impurities such as carbon and the like, which remain on the surface of the electrode, and the recesses and projections on the surface are controlled by setting the state of the surface of the electrode to predetermined conditions, the scattering of the substance for the electrode and the blinking of discharge can be significantly improved.

In the field of the high-pressure discharge lamp, the technique for improving the decrease in the luminous flux maintenance factor and the discharge blinking phenomenon, which are caused by the decrease in the light transmittance, which are due to the blackening, whitening or the loss of clarity, is disclosed in, for example, Jpn. Pat. Appln. KOKOKU Publication No. 5-86026.

However, the above-mentioned prior art technique, although an effect can be obtained to some extent, is not an essential countermeasure to the blackening caused by remaining carbon, but rather a secondary countermeasure (after treatment). Thus, the prior art technique is not an ultimate solution. As a result, the effect and stability of the degree which can be achieved by the prior art technique are not sufficiently satisfactory.

BRIEF SUMMARY OF THE INVENTION

An object of the present invention is to provide a high-pressure discharge lamp in which impurities such as carbon and the like, which remain on the surface of the electrode, are lessened, by setting the state of the surface of the electrode to predetermined conditions, and a lighting device which uses the discharge lamp.

The present invention has been proposed based on the finding by the inventors that the rapid decrease in the luminous flux maintaining factor within 100 hours of lighting is caused by the blackening of the discharge container with carbon, and the main factor of the blackening is carbon remaining on the surface of the electrode. Thus, another object of the present invention is to provide a high-pressure discharge lamp which has an improved luminous flux maintenance factor and luminous efficiency within 100 hours of lighting, and a lighting device which uses the discharge lamp.

The first high-pressure discharge lamp of the present invention is characterized by including a light-transmitting and air-tight discharge container, an electrode made of a material whose main component is tungsten, and having a surface whose center line average roughness Ra is 0.3 $\mu$m or less, which is sealed in the discharge container, and a discharge medium containing a halide of a light emitting metal and sealed in the discharge container.

In the first invention and each of the other inventions, the following terms will be defined and have technical meanings as blow as long as they are especially designated.

Regarding the discharge container:

The material which constitutes the discharge container may be either one of light-transmitting ceramics and quartz glass.

First, the light-transmitting ceramic discharge container will now be described.

The "light-transmitting ceramics" mean fire resisting materials including a monocrystal metal oxide such as sapphire, a polycrystal metal oxide such as semitransparent air-tight aluminum oxide (DGA), yttrium-aluminum-garnet (YAG) or yttrium oxide (YOX), and a polycrystal non-oxide such as aluminum nitride (AlN).

It should be noted that the "light-transmitting" property is meant to be at least such a degree that light emitted by discharge can be guided to outside as transmitting through the discharge container, and it may be either transparent or diffusion light-transmitting.

In the case of the light-transmitting ceramic discharge container, generally, a pair of end portions are formed at both ends of a swelling portion, in which discharge is made to occur, and the sealing is made at the end portions.

In the manufacture of the discharge container, the swelling portion and the end portions can be formed of light-transmitting ceramics integrally from the beginning. As an alternative method, it is possible that a swelling portion is prepared by forming a cylindrical body and a pair of end plates each having a hole at its center, which close both ends of the cylindrical body, of a ceramic material, by preliminary formation, and end portions by inserting slender tubes formed of a ceramic material or cermet material by preliminary formation, into the center holes of the end plates, and assembling them into a shape of a discharge container, followed by sintering to integrate them air-tightly.

In the sealing at the end portions of the discharge container, a sealing metal portion of an feeding conductor is mounted air-tightly via the sealing of the ceramic sealing compound, which will be described later. However, in the present invention, a ceramic sealing compound is not essential to the sealing of the light-transmitting ceramic discharge container, but any sealing will do as long as it is sealed with appropriate means.

Next, the quartz glass discharge container will now be described.

Quartz glass discharge containers have been widely used before the use of light-transmitting ceramic discharge containers started, and they are still used.

Generally a quartz glass discharge container consists of a swelling portion at center and a pair of end portions as in the case of a light-transmitting ceramic discharge container. However, quartz glass softens when heated, and melts; therefore generally, it is sealed with pinch seals at the end portions, where sealing metal foils are used. However, in the present invention, a pinch seal which uses a sealing metal foil is not essential, but any sealing will do as long as it is sealed with appropriate means.

Regarding the electrode

First, the roughness of the surface of the electrode will now be described.

The electrode sealed in a discharge container functions to render discharge to occur in the discharge container, and the average of the center line average roughness Ra of the surface must be limited to 0.3 $\mu$m or less. It should be noted that, in the present invention, the "center line average roughness Ra" is defined as follows. That is, a center line is obtained from the height curve, and waveform portions located below the center line is folded up at the center line. Then, the total of the areas surrounded with respect to the center line is divided by the measured length, thus obtaining the center line average roughness. This is defined by JIS B0601; however the actual measurement is performed as follows. Also, it should be noted that the average value is that of the result of measurements carried out at multiple points of a sample within a range of 120 $\mu$m×90 $\mu$m.

That is, as the measuring device, "Electron Beam 3-Dimensional Roughness Analyzing Device ERA-8000 type" of Elionisk Inc. is used to photograph the surface of the electrode, which is further enlarged by 1000 times to be analyzed.

The surface of the electrode is measured as a surface of an electrode axial portion adjacent to the main portion of an electrode coil or the like, based on how easily the roughness of the surface can be measured and the degree of the influence regarding the scattering of the substance for the electrode.

The reason for limiting the roughness of the surface of the electrode as described above is that the amount of impurities attached is lessened, and therefore the scattering of the electrode substance is generally less, thus improving the luminous flux maintenance factor, and the blinking of discharge is lessened. On the other hand, when the above range exceeds, there is a tendency that the scattering amount of the substance of the electrode is increased and the rate of blinking of electrical discharge is increased.

It should be noted that in the present invention, the means for suppressing the roughness of the surface is arbitrary. For example, a desired surface roughness can be obtained by chemical polishing.

In the meantime, in the present invention, the reason why the electrode is limited to that containing tungsten as the main component is not only that tungsten is generally widely used as a material for electrodes because of its excellent heat resistance and electron radiating property, but also that in the course of manufacturing a tungsten material and electrode, impurities such as WC, W2C and tungsten aluminate are easily absorbed in the surface.

The expression "tungsten as the main component" means that tungsten is allowed to be genuine tungsten or tungsten containing sub-components. Examples of tungsten containing sub-components are so-called doped tungsten and Re-added tungsten.

Further, in the present invention, it suffices if at least one of the pair of electrode satisfies the limitation of the roughness of the surface. This is because at least one half of the effect can be obtained.

Next, the structure of the electrode will now be described.

In the present invention, the structure of the electrode is arbitrary. An appropriate type can be selected for use, from conventional electrode structures in accordance with the rated consumption power of the high-pressure discharge lamp.

The high-pressure discharge lamp of the present invention may be structured such as to be turned on by either alternating or direct current. Therefore, in the case where the lamp is operated by alternating current, the electrodes are formed to have the same structure, whereas in the case where it is operated by direct current, the anode should be of a type having a heat radiating area larger than that of the cathode since the increase in the temperature is generally intense in the anode.

Further, the sealing and fixing of the electrode and the sealing of the discharge container will now be described.

First, the case of the light-transmitting ceramic discharge container will be explained.

That is, in the case of the light-transmitting ceramic discharge container, the electrodes are fixed and sealed via an feeding conductor, and the discharge container is sealed.

The feeding conductor is made of a sealed metal portion and an anti-halogenation material portion provided at a tip end of the sealed metal portion.

The sealed metal portion is made of a metal rod of, for example, niobium which has a thermal expansion coefficient closer to that of light-transmitting ceramics.

As the anti-halogenation material portion, a metal rod of, for example, molybdenum or tungsten, is used. Since molybdenum has a thermal expansion coefficient closer to that of niobium or ceramics than that of tungsten, a relatively short molybdenum rod is used for the section to be connected to the sealed metal portion, and a tungsten rod can be connected to the tip end of the molybdenum rod.

Further, a slender wire made of molybdenum or tungsten can be wound around the anti-halogenation portion. This coil is called capillary coil.

It should be noted that when at least the most of the anti-halogenation material is made of a tungsten rod, and a tungsten capillary coil is prepared, the difference in thermal expansion coefficient between the sealed metal portion and ceramic portion can be absorbed while reducing the scattering amount of impurities from the feeding conductor. Therefore, excellent sealing can be achieved.

Thus, an electrode is provided at the tip end of the tungsten rod. Here, it is possible that the proximal end of the electrode shaft is connected to the tip end of the tungsten rod of the anti-halogenation material portion, an electrode coil is mounted on the tip end portion of the tungsten rod, or the electrode can be formed to be integrated with the anti-halogenation material portion without being mounted.

Next, the sealed metal portion is inserted such that a part thereof is located in the end portion of the discharge container, and the ceramic sealing compound is applied to the end portion. Further, it is melted by heat so as to form a seal between the sealed metal portion and the end portion. It should be noted that the portion of the feeding conductor, which has a sealing property, is easily eroded by a halogen, and therefore it is preferable that the portion located in the end portion should be covered completely with the seal of the ceramic sealing compound.

In the ceramic discharge lamp completed by the above-described steps, a part of the sealing metal portion of the feeding conductor projects from the end portion of the discharge container to the outside, and therefore the part serves as a lead wire for applying a voltage between the electrodes via a ballast means, to start the high-pressure discharge lamp, and introducing a current for the lamp to light up.

In the meantime, a small gap called capillary is made between the end portion of the light-transmitting ceramic discharge container and the anti-halogenation portion (the electrode shaft of tungsten and/or the molybdenum rod) of the feeding conductor. The small gap is made in a space created between the anti-halogenation portion of the feeding conductor and the inner surface of the end portion of the discharge container, having at least 5 $\mu$m, having a size, at maximum, of ¼ of the inner diameter of the end portion, and about 200 $\mu$m or less. For this reason, the diameter of the anti-halogenation material portion of the feeding conductor which pierces through the end portion is set at least ½ of the inner diameter of the end portion.

Alternatively, the small gap can be formed between the outer circumferential surface of the coil of the anti-halogenation material portion and the inner surface of the end portion. The anti-halogenation material portion of the feeding conductor is made of a tungsten or molybdenum rod and a coil wound around the rod.

Further, while operating the ceramic discharge lamp, an excessive halide material in the liquid state enters the small gap to form the coolest portion; however by setting the width of the gap appropriately, a desired coolest temperature can be achieved.

The seal of the ceramic sealing compound has a heat resistance sufficient to withstand a high temperature of the high-pressure discharge lamp while it is on, and the thermal expansion coefficient is adjusted to an intermediate between that of the lead wire and that of the light-transmitting ceramic discharge container. For example, $Al_2O_3$—$SiO_2$—$Dy_2O_3$-based or $Al_2O_3$—$SiO_2$—$Nd_2O_3$-based ceramic sealing compound can be used.

Next, the sealing of the electrodes and discharge container in the case of the quartz glass discharge container will now be described.

Electrode shafts and outside lead wire are welded to both ends of a sealed metal foil made of molybdenum, to prepare an electrode assembly body, and it is inserted to the end portion of the glass discharge container from the electrode such that the sealed metal foil is situated at the end portion. Then, the end portion is softened by heat, and pinched over the sealing metal foil with use of a mold. Thus, the sealed metal foil and the pinched quartz glass are air-tightly sealed. The electrode shafts are softened, and loosely supported by the end portion whose diameter has been reduced.

Regarding the discharge medium

A discharge medium consists of a halide of a light emitting metal as an essential material, and, if necessary, others such as noble gas and a buffer medium which set the lamp voltage to a predetermined value.

As a light-emitting metal, an arbitrary and desired one can be selected for use, and for example, sodium Na, scandium Sc and a rare earth metal may be used solely or in a mixture of a plurality of types. It should be noted that as a halogen, iodine I, bromine Br, chlorine Cl, or fluorine F can be used.

As the noble gas, argon Ar, krypton Kr or xenon Xe can be used mainly for starting. Further, for the ceramic discharge container, neon can be used.

As the buffer medium, mercury or, in place of mercury, a halide of a metal which does not emit light in a visible range or emits relatively less light, and has a vapor pressure relatively high such as aluminum Al or iron Fe can be used solely or a plurality of such halides can be used.

Regarding the other structures:

The high-pressure discharge lamp of the present invention may be of a short arc type or a long arc types The short-arc type is a so-called electrode stabilization type, which stabilizes an arc discharge with the electrodes by reducing the inter-electrode distance set between a pair of electrodes in the discharge container. The short-arc type high-pressure discharge lamp is used for, for example, a liquid crystal projector, and a front light of an automobile.

On the other hand, the long-arc type is a so-called tube wall stabilization type, in which the arc discharge is stabilized in the inner surface of the discharge container, by increasing the inter-electrode distance set between a pair of electrodes in the discharge contained, to be larger than the inner diameter of the swelling portion of the discharge container tube section. The long-arc type high-pressure discharge lamp is widely used in general illumination lights.

Regarding the effect of the present invention:

In the high-pressure discharge lamp according to the first aspect of the present invention, with the regulation of the average value of the center line average roughness Ra of the surface of the electrode set to 0.3 $\mu$m or less, impurities which include mainly carbon and the like, created by marks including a dies mark made during wire drawing of tungsten or from the lubricant and polisher remaining as they attach to the surface, are eliminated substantially completely, and therefore the decrease in the transmittance, due to the blackening, whitening, or the loss clarity of the discharge container, is markedly lessened. As a result, the luminous flux maintenance factor is improved.

Further, the irregularity of the surface of the electrode is reduced, and therefore the blinking phenomenon of the discharge is essentially improved.

In the high-pressure discharge lamp according to the second aspect of the present invention, the electrode has an average value of the center line average roughness Ra of the surface, that is 0.1 $\mu$m or less.

In the present invention, the average value of the center line average roughness Ra of the surface of the electrode is limited further strictly as described above. Therefore, marks such as dies marks created during wire drawing, impurities such as lubricant and polisher remaining as being attached in the marks, or impurities including a polisher, attached due to mechanical polishing such as barrel polishing carried out after grinding, are substantially completely removed. In this manner, the decrease in the transmittance, caused by the blackening, whitening or the loss of clarity of the discharge container, can be significantly lessened. Therefore, the luminous flux maintenance factor is further improved. Further, since the irregularity on the surface of the electrode is further lessened, the blinking of the discharge can be significantly improved.

The high-pressure discharge lamp according to the third aspect of the present invention, comprises: a light-transmitting air-tight discharge container; electrodes having an average value of ten-point average roughness Rz on the surface, of 1 $\mu$m or less, made of tungsten as a main component and sealed in the discharge container; and a discharge medium containing a halide of a light-emitting metal and sealed in the discharge container.

In the present invention, the roughness of the surface of the electrode is limited with the average value of the ten-point average roughness Rz on the surface of the electrode. Further, as the average value of the ten-point average roughness Rz is limited to a predetermined range, marks including a dies mark made during drawing of wire, and impurities remaining as they are attached to the marks, are eliminated substantially completely, and therefore the decrease in the transmittance, due to the blackening, whitening, or the loss of clarity of the discharge container, is markedly lessened. As a result, the luminous flux maintenance factor is improved.

Further, since the irregularity of the surface of the electrode becomes less, the discharge blinking phenomenon is essentially improved.

By contrast, when exceeding the above-described range, there is a tendency that the amount of the electrode material scattered is increased, and the blinking of discharge is increased.

It should be noted that the "ten-point average roughness Rz" is a value obtained by taking the difference between the average value of the first to fifth highest peaks of the planes in parallel with the average line within a designated area, and the average of the first to fifth deepest troughs. The "ten-point average roughness Rz" is defined in JIS B0601. Further, the average value is similar to the contents described in connection with the high-pressure discharge lamp of the first aspect. The measurement thereof is similar to the contents described in connection with the high-pressure discharge lamp according to the first aspect.

In the present invention, the average value of the ten-point average roughness Rz is not necessarily correlated to the average value of the center line average roughness Ra.

The high-pressure discharge lamp according to the fourth aspect of the present invention, is based on the third high-pressure discharge lamp, further to have a feature that the electrode has an average value of the ten-point average roughness Rz of the surface, that is 0.3 $\mu$m or less.

In the present invention, the average value of the ten-point average roughness Rz of the surface of the electrode is limited further strictly as described above. Therefore, marks such as dies marks created during wire drawing, impurities such as lubricant and polisher remaining as being attached in the marks, or impurities including a polisher, attached due to mechanical polishing such as barrel polishing carried out after grinding, are substantially completely removed. In this manner, the decrease in the transmittance, caused by the blackening, whitening or the loss of clarity of the discharge container, can be significantly lessened. Therefore, the luminous flux maintenance factor is further improved. Further, since the irregularity on the surface of the electrode is further lessened, the blinking of the discharge can be significantly improved.

The high-pressure discharge lamp according to the fifth aspect of the present invention, comprises: a light-transmitting air-tight discharge container; electrodes having an average value of surface area increasing rate on the surface, of 1% or less, made of tungsten as a main component and sealed in the discharge container; and a discharge medium sealed in the discharge container.

In the present invention, the roughness of the surface of the electrode is limited with the average value of the "surface area increasing rate" on the surface of the electrode. Further, as the average value of the surface area increasing rate is limited to 1% or less, marks including a dies mark made during drawing of wire, and impurities such as lubricant and polisher, remaining as they are attached to the marks, are eliminated substantially completely, and therefore the decrease in the transmittance, due to the blackening, whitening, or the loss of clarity of the discharge container, is markedly lessened. As a result, the luminous flux maintenance factor is improved.

Further, since the irregularity of the surface of the electrode becomes less, the discharge blinking phenomenon is essentially improved.

By contrast, when exceeding the above-described range, there is a tendency that the amount of the electrode material scattered is increased, and the blinking of discharge is increased.

It should be noted that the "surface area increasing rate" used in the present invention is meant to be a value obtained by dividing the surface area of a sample, obtained by measurement, with the area of the measured range, length× width. The measurement thereof is similar to the contents described in connection with the high-pressure discharge lamp according to the first aspect. Further, the average value is similar to the contents described in connection with the high-pressure discharge lamp of the first aspect.

The sixth high-pressure discharge lamp of the present invention is based on the fifth high-pressure discharge lamp, and is characterized in that the surface area increasing rate of the surface of the electrode is 0.6% or less.

In the present invention, the average value of the surface area increasing rate of the surface of the electrode is limited further strictly as described above. Therefore, marks such as dies marks created during wire drawing, impurities such as lubricant and polisher remaining as being attached in the marks, or impurities including a polisher, attached due to mechanical polishing such as barrel polishing carried out after grinding, are substantially completely removed. In this manner, the decrease in the transmittance, caused by the blackening, whitening or the loss of clarity of the discharge container, can be significantly lessened. Therefore, the luminous flux maintenance factor is further improved.

Further, since the irregularity on the surface of the electrode is further lessened, the blinking of the discharge can be significantly improved.

The high-pressure discharge lamp according to the seventh aspect of the present invention is based on the high-pressure discharge lamp according to the first, third, fifth or sixth aspect, and is characterized in that the electrode has an average value of the center line average roughness Ra of the surface, of 0.3 $\mu$m or less and an average value of the ten-point average roughness Rz of the surface, of 1 $\mu$m or less.

In the present invention, the roughness of the surface of the electrode is limited with the average value of the center line average roughness Ra and the average value of the ten-point average roughness Rz. Further, when they are limited as described above, a more excellent result can be obtained regarding the luminous flux maintenance factor and the blinking of discharge, than in the case where each of them is used solely.

The high-pressure discharge lamp according to the eighth aspect of the present invention is based on the high-pressure discharge lamp according to the first, third, fourth or fifth aspect, and is characterized in that the electrode has an average value of the center line average roughness Ra of the surface, of 0.3 $\mu$m or less and an average value of the surface area increasing rate eq #, of 1% or less.

In the present invention, the roughness of the surface of the electrode is limited with the average value of the center line average roughness Ra and the average value of the surface area increasing rate. Further, when they are limited as described above, a more excellent result can be obtained regarding the luminous flux maintenance factor and the blinking of discharge, than in the case where each of them is used solely.

The high-pressure discharge lamp according to the ninth aspect of the present invention is based on the high-pressure discharge lamp according to one of the first to third, and fifth to eighth aspect, and is characterized in that the electrode has an average value of the center line average roughness Ra of the surface, of 0.1 $\mu$m or less and an average value of the ten-point average roughness Rz of the surface, of 0.4 $\mu$m or less.

In the present invention, the roughness of the surface of the electrode is limited further strictly with the average value of the center line average roughness Ra and the average value of the ten-point average roughness Rz. Further, when they are limited as described above, a more excellent result can be obtained regarding the luminous flux maintenance factor and the blinking of discharge, than in the case where each of them is used solely.

The high-pressure discharge lamp according to the tenth aspect of the present invention is based on the high-pressure discharge lamp according to one of the first to fifth and seventh to ninth aspect, and is characterized in that the electrode has an average value of the center line average roughness Ra of the surface, of 0.1 $\mu$m or less and an average value of the surface area increasing rate eq #, of 0.7% or less.

In the present invention, the roughness of the surface of the electrode is limited further strictly with the average value of the center line average roughness Ra and the average value of the surface area increasing rate. Further, when they are limited as described above, a more excellent result can be obtained regarding the luminous flux maintenance factor and the blinking of discharge, than in the case where each of them is used solely.

The high-pressure discharge lamp according to the eleventh aspect of the present invention is based on one of the high-pressure discharge lamp of the first to tenth aspects, and is characterized by the electrode in which the electrode shaft is manufactured via a wire drawing step.

When the electrode shaft is manufactured via the wire drawing step, a further excellent result can be obtained than in the case where it is manufactured via a mechanical polishing step such as barrel polishing. Although the reason is not very much clear, it is considered that alumina, which is used as a polisher for mechanical polishing, easily remains on the surface of the surface of the electrode.

It should be noted that whether or not it has been manufactured via a wire drawing step can be easily analyzed by measuring if a dies mark is present or absent on the surface of the electrode with the before-mentioned electron beam 3-dimensional roughness analysis device even in the case of an electrode which was chemically polished after the wire drawing.

The high-pressure discharge lamp according to the twelfth aspect of the present invention is based on one of the high-pressure discharge lamp of the first to eleventh aspects, and is characterized by the electrode which is manufactured via a chemical polishing step.

The chemical polishing is a step appropriate for achieving a roughness of the surface, which is defined for the high-pressure discharge lamp of the present invention. There are several ways of the chemical polishing, namely, the polishing method which uses an acid such as hydrofluoric acid, one which uses an alkali such as a solution of 5% by weight of sodium hydroxide, and the electrolytic polishing.

Further, it suffices if the chemical polishing is carried out onto the entire electrode or the main body thereof. The main body includes the electrode main part and portions adjacent thereto. The electrode main part and the portion adjacent thereto become hot as they are exposed to the discharge while lighting up, and the electrode substance is easily scattered. By contrast, the portion connected to the sealed metal foil and portion covered by quartz glass have relatively low temperatures, and therefore the amount of the electrode substance scattered is small.

In the case where the electrode is chemically polished, a crystal grain boundary appears clearly on the surface of the electrode, and therefore it can be easily judged.

The high-pressure discharge lamp according to the thirteenth aspect of the present invention is based on one of the high-pressure discharge lamp of the first to twelfth aspects, and is characterized by the electrode whose surface has a linear reflection coefficient of 30% or higher.

In the present invention, the roughness of the surface of the electrode is limited with the linear reflection coefficient. The linear reflection coefficient can be measured with use of a plate made of the same material as that of the electrode, which has been subjected to the same surface treatment as that. When the linear reflection coefficient is in the above range, the surface of the electrode is smooth, and therefore the amount of the electrode substance scattered is lessened, thus reducing the decrease in the transmittance of the discharge container. Therefore, the luminous flux maintenance factor is improved.

Further, since the irregularity on the surface of the electrode is suppressed, the blinking of discharge is improved.

When the linear reflection coefficient becomes 55% or more, an extremely good effect can be obtained.

The high-pressure discharge lamp according to the fourteenth aspect of the present invention is based on one of the high-pressure discharge lamp of the first to thirteenth aspects, and is characterized in that the discharge medium contains a halide of a light emitting metal, and tin halide in such an amount that it does not substantially contribute to the light emission.

In the present invention, with the addition of tin halide to the discharge medium, the impurities within the discharge container are eliminated, and therefore a further better luminous flux maintenance factor can be obtained.

Further, tin halide sealed for the practice of the present invention should preferably be in a range of $0.1\times10^{-3}$ to $2\times10^{-3}$ mol/cc. When the amount of tin halide sealed is excessively large, the light emission by tin increases, thus decreasing the luminous efficiency. Reversely, when the amount sealed is small, it becomes difficult to obtain the effect of the elimination of impurities.

The high-pressure discharge lamp according to the fifteenth aspect of the present invention comprises: a light-transmitting air-tight discharge container; an electrode sealed and fixed in the discharge container, and having an amount of carbon remaining on the surface, of 25 ppm or less; and a discharge medium containing at least a halide of a light-emitting metal and sealed in the discharge container.

The discharge container may be either one of a light-transmitting ceramic discharge container type or a quartz glass discharge container type.

The electrode may be of any structure type as long as the amount of carbon remaining on the surface is 25 ppm or less. It should be noted the remaining carbon amount is in a value analyzed in the state of a brand-new high-pressure discharge lamp before use. In other words, it is an analysis value of an as-yet-unused state after aging in the factory.

Further, the amount of carbon remaining on the surface of the electrode includes that of carbon as a single substance and that in the form of a carbon compound such as WC or $W_2C$. It should be noted that the surface of the electrode is meant to be a portion taken from the surface to a depth of 2 to 3 $\mu$m.

In order to restrict the remaining carbon amount within the above-described range, a heat treatment may be carried out within a hydrogen atmosphere or vacuum atmosphere in addition to the above-described polishing.

The high-pressure discharge lamp according to the sixteenth aspect of the present invention comprises: a light-transmitting air-tight discharge container having a swelling portion which surrounds a discharge space and end portions having an inner diameter smaller than that of the swelling portion, and connected to both ends of the swelling portion; a feeding conductor having an anti-halogenation material portion having a proximal portion connected to a sealing portion and a tip end of the sealing portion, and forming a small gap between the anti-halogenation material portion and the inner surface of the end portion; an electrode provided on the tip end of the anti-halogenation material portion of the feeding conductor to be situated within the swelling portion of the light-transmitting ceramic discharge container, and having an amount of carbon remaining on the surface, of 25 ppm or less; a seal of a ceramic sealing compound for sealing a gap between the end portion of the light-transmitting ceramic discharge container and the sealing portion of the feeding conductor; and a discharge medium containing at least a halide of a light-emitting metal and sealed in the discharge container.

In the high-pressure discharge lamp which comprises the light-transmitting ceramic discharge container, the decrease in the luminous flux maintenance factor within 100 hours of lighting is due to the blackening of the light-transmitting ceramic discharge container, and the blackening occurs due to carbon remaining on the surface of the electrode, as described before. By limiting the amount of carbon remaining on the surface of the electrode as set above, the decrease in the luminous flux maintenance factor can be significantly improved. If the amount of carbon remaining on the surface of the electrode is 25 ppm or less, a sufficiently high luminous flux maintenance factor can be obtained within 100 hours of lighting.

The amount of carbon remaining on the surface of the electrode is measured by a high frequency induction heating—infrared ray absorption method.

The high-pressure discharge lamp according to the seventeenth aspect of the present invention is based on the high-pressure discharge lamp of the fifteenth or sixteenth aspect, and is characterized in that the amount of carbon remaining on the surface of the electrode is 13 ppm or less.

In the present invention, by limiting the amount of carbon remaining on the surface of the electrode as set above, an optimal luminous flux maintenance factor can be obtained within 100 hours of lighting.

The high-pressure discharge lamp according to the eighteenth aspect of the present invention is based on the high-pressure discharge lamp of the sixteenth aspect, and is characterized in that the feeding conductor includes an anti-halogenation material portion made of a tungsten rod or a tungsten wire wound around a tungsten rod.

In the present invention, the anti-halogenation material portion of the feeding conductor is structured as above, and thus it becomes possible to provide a high-pressure discharge lamp having a light-transmitting ceramic discharge container in which the scattering of the impurities is relatively lessened and the problem of the thermal expansion coefficient is suppressed.

That is, in the case of the high-pressure discharge lamp comprising the light-transmitting ceramic discharge container, for sealing the light-transmitting ceramic discharge container, the anti-halogenation material portion made of a molybdenum rod is provided at the tip end of the sealing metal portion such as of niobium by bonding, and further, in accordance with necessity, the feeding conductor prepared by winding a molybdenum wire around the anti-halogenation material portion, so-called a capillary coil, is used. Then, the electrode made of tungsten is connected to the tip end of the anti-halogenation material portion of the feeding conductor, and the sealing metal portion is situated to the end portion of the discharge container to fix and seal it with use of a seal of a ceramic sealing compound. At that time, the seal is extended to the portion corresponding to the molybdenum rod so as to completely cover the sealing metal portion with the seal. In this manner, the portion is protected from corrosion by halide.

Since the molybdenum rod of the anti-halogenation material portion has a thermal expansion coefficient smaller than that of tungsten, it has relatively a good adaptation with respect to the sealing metal portion having a further smaller thermal expansion coefficient, the seal of the ceramic sealing compound and the light-transmitting ceramics. However, there is a drawback that molybdenum easily allows the attachment of impurities including carbon, as compared to tungsten.

Therefore, in the present invention, the tungsten rod is used for the anti-halogenation material portion of the feeding conductor and a tungsten wire is wound around the tungsten rod, thus absorbing the difference in thermal expansion coefficient between the seal for the tungsten rod, which is made of the ceramic sealing compound and the light-transmitting ceramic discharge container.

In the present invention, even the scattering of impurities including carbon from the feeding conductor can be relatively reduced, and therefore the luminous flux maintenance factor becomes further better.

The lighting device of the present invention comprises: a lighting device main body; and a high-pressure discharge lamp according to one of the first to eighteenth aspects, mounted on the lighting device main body.

The present invention can be applied to all of the devices which are utilized for any purpose with use of the high-pressure discharge lamp of the present invention described above as a light source, and these devices are, as a whole, called lighting devices. For example, they are various types of lighting devices, display devices and projector devices. The lighting devices include outdoor and indoor types. As the projector devices, the present invention can be applied to the liquid crystal projector, overhead projector, search light, and head lamp of a movable body.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be described with reference to drawings.

Figure 1:
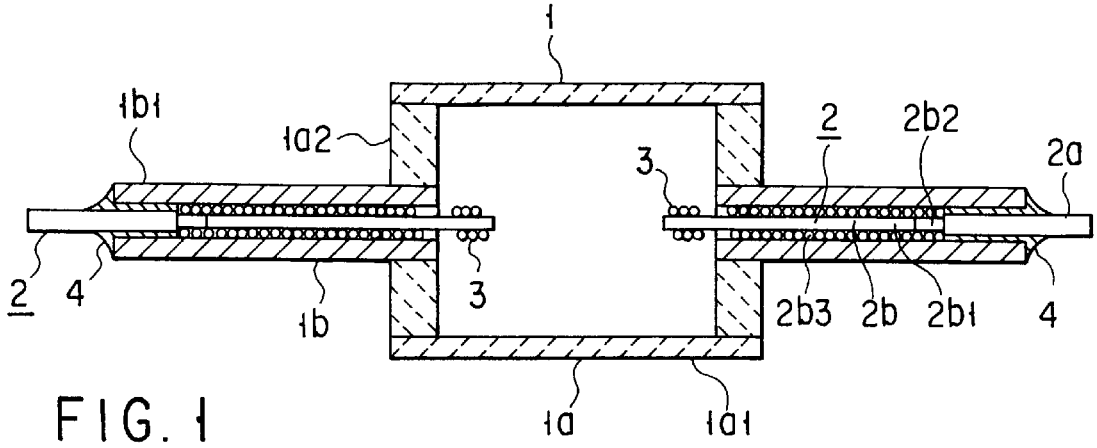
FIG. 1 is a cross sectional view of the high-pressure discharge lamp according to the first embodiment of the present invention.

FIG. 1 is a cross sectional view of a high-pressure discharge lamp according to the first embodiment of the present invention.

In this figure, reference numeral 1 denotes a translucent ceramic discharge container, numeral 2 denotes a feeding conductor, numeral 3 denotes an electrode, and numeral 4 denotes a seal of a ceramic-sealing compound.

The translucent ceramic discharge container 1 includes a swelling portion 1*a* and a pair of end portions 1*b* and 1*b*.

The swelling portion 1*a* is made of translucent alumina ceramic, and has an inner diameter of 9 mm and a full length of 13 mm. The swelling portion 1*a* consists of a cylindrical portion 1*a*1 and a pair of disks 1*a*2 and 1*a*2 designed to close both end surfaces thereof and having central holes. These are separately formed halfway through, and then assembled together. Further, a semi-formed product of the end portion 1*b* is assembled, and sintered together with other sections, thus forming an air-tight discharge container 1 as an integral unit.

The end portion 1*b* is made of translucent alumina ceramics, and has an inner diameter of 1 mm, a length of 12 mm and thickness of about 1 mm. In the end portion 1*b*, the end which is on the opposite side to the swelling portion 1*a* functions as a sealing portion 1*b*1, and the sealing metal portion 2*a* of the feeding conductor 2 is sealed with a seal 4 of the ceramic sealing compound, which will be later explained.

The feeding conductor 2 consists of the sealing metal portion 2*a* and an anti-halogenation portion 2*b*.

The sealing metal portion 2*a* is made of a niobium rod having an outer diameter of 0.9 mm and an insertion depth to the sealing portion 1*b*1 of the end portion 1*b*, of 7 mm.

The anti-halogenation material portion 2*b* consists of a tungsten rod 2*b*1 having an outer diameter of 0.4 mm, a molybdenum rod 2*b*2 and a molybdenum coil 2*b*3, and is welded coaxially to the tip end of the sealing metal portion 2*a* by laser. Further, the molybdenum coil 2*b*3 is made of a molybdenum wire having an outer diameter of 0.25 mm, which is wound on the outer circumference of the tungsten rod 2*b*1 and molybdenum rod 2*b*2 made by a wire drawing method.

The electrode 3 is made by winding a tungsten wire having an outer diameter 0.3 mm, formed by a wire drawing method, around the tip end of the anti-halogenation material portion 2*b*. The electrode 3 was polished by electrolyzing in a solution of 5% by weight of sodium hydroxide before sealed in the translucent ceramic discharge container 1.

Figure 2:
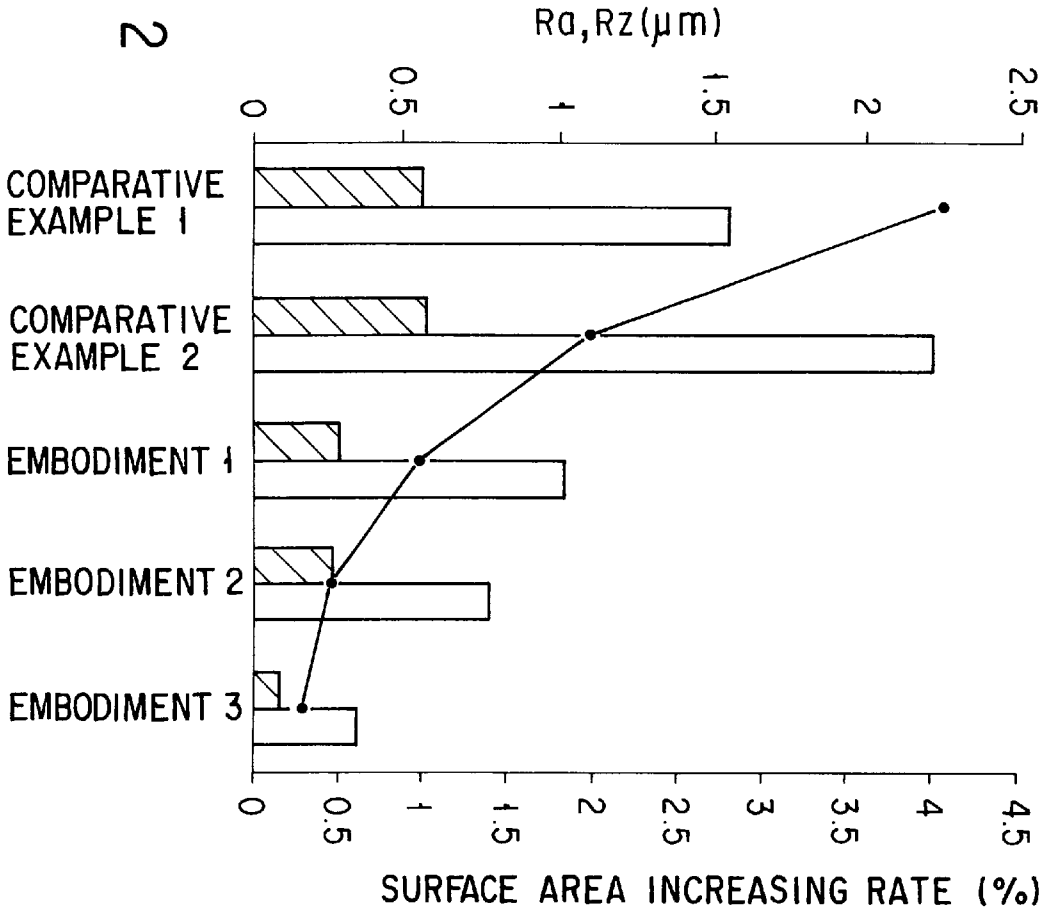
FIG. 2 is a graph indicating a surface roughness of the electrode (center line average roughness Ra, ten-point average roughness Rz), and a surface area increasing rate, of the high-pressure discharge lamp according to the first embodiment of the present invention, together with those of comparative examples.

FIG. 2 is a graph indicating a surface roughness of the electrode (center line average roughness Ra, ten-point average roughness Rz), and a surface area increasing rate, of the high-pressure discharge lamp according to the first embodiment of the present invention, together with those of comparative examples.

In the figure, the abscissa indicates electrodes of embodiments of the present invention and comparative examples, and the ordinate indicates Ra and Rz ($\mu$m) on the left side, and the surface area increasing rate (%) on the right side. Further, the shaded rectangles indicate Ra and the unshaded rectangles indicate Rz in the histogram, and the line of the line chart indicates the surface area increasing rate. It should be noted here that the indications of Ra and Rz are made as average values.

Embodiments

Embodiment 1: Electrolytic Polishing, 30 seconds

Embodiment 2: Ditto, 60 seconds

Embodiment 3: Ditto, 90 seconds

Comparative Examples

Comparative Example 1: Hydrogen Treatment (1650° C., 10 minutes)

Comparative Example 2: Hydrogen Treatment (ditto) and Vacuum Treatment (1200° C., 30 minutes)

Figure 3:
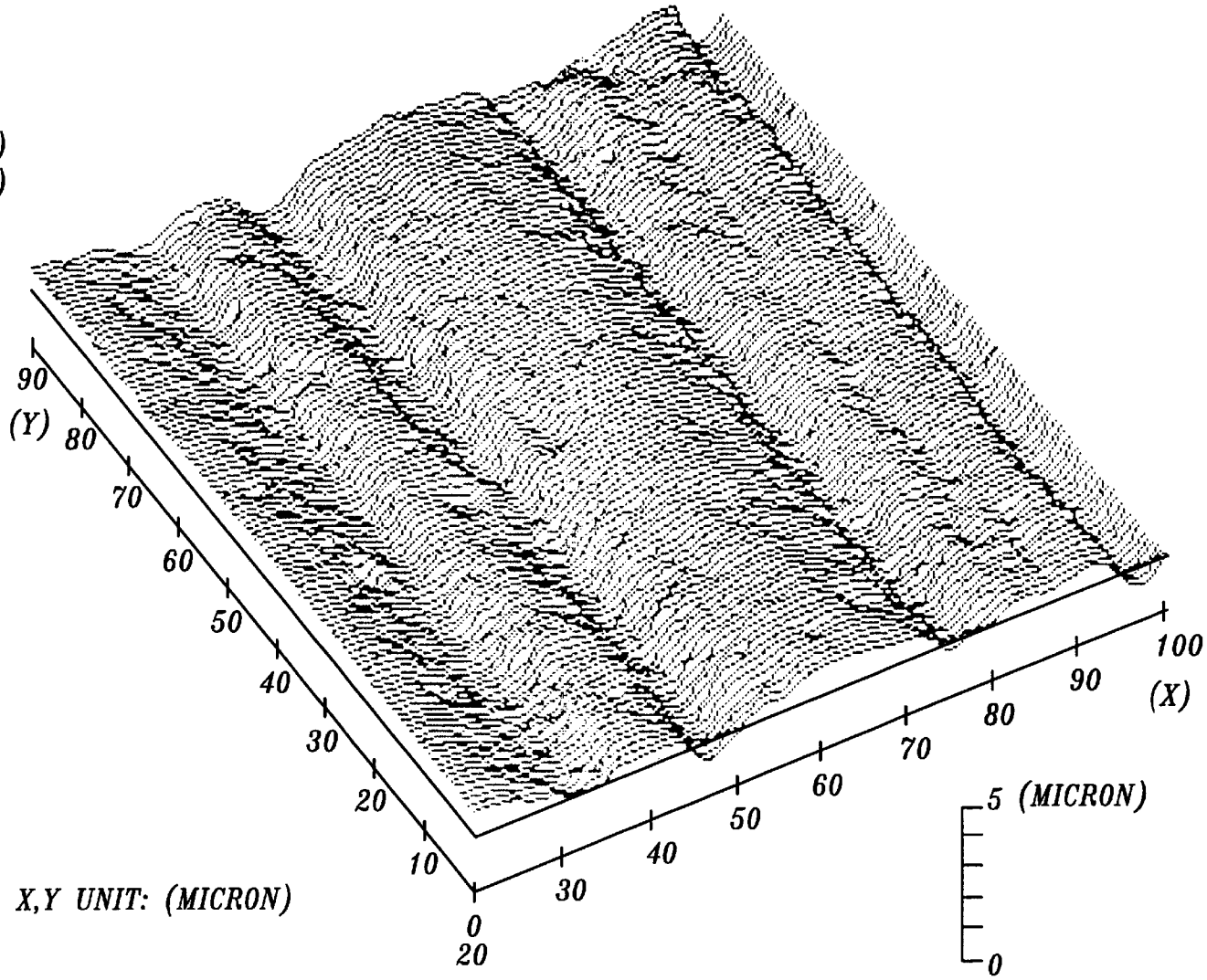
FIG. 3 is a three-dimensional electron microscope photograph of the surface of the electrode before the electrolytic polishing of the electrode, used for the high-pressure discharge lamp according to the first embodiment of the present invention.

In the meantime, FIG. 3 is a three-dimensional electron microscope photograph of the surface of the electrode before the electrolytic polishing of the electrode, used for the high-pressure discharge lamp according to the first embodiment of the present invention. In this case, the center line average roughness Ra is 0.5612 $\mu$m, the ten-point average roughness Rz is 1.549 $\mu$m and the surface area increasing rate is 0.04041%.

Figure 4:
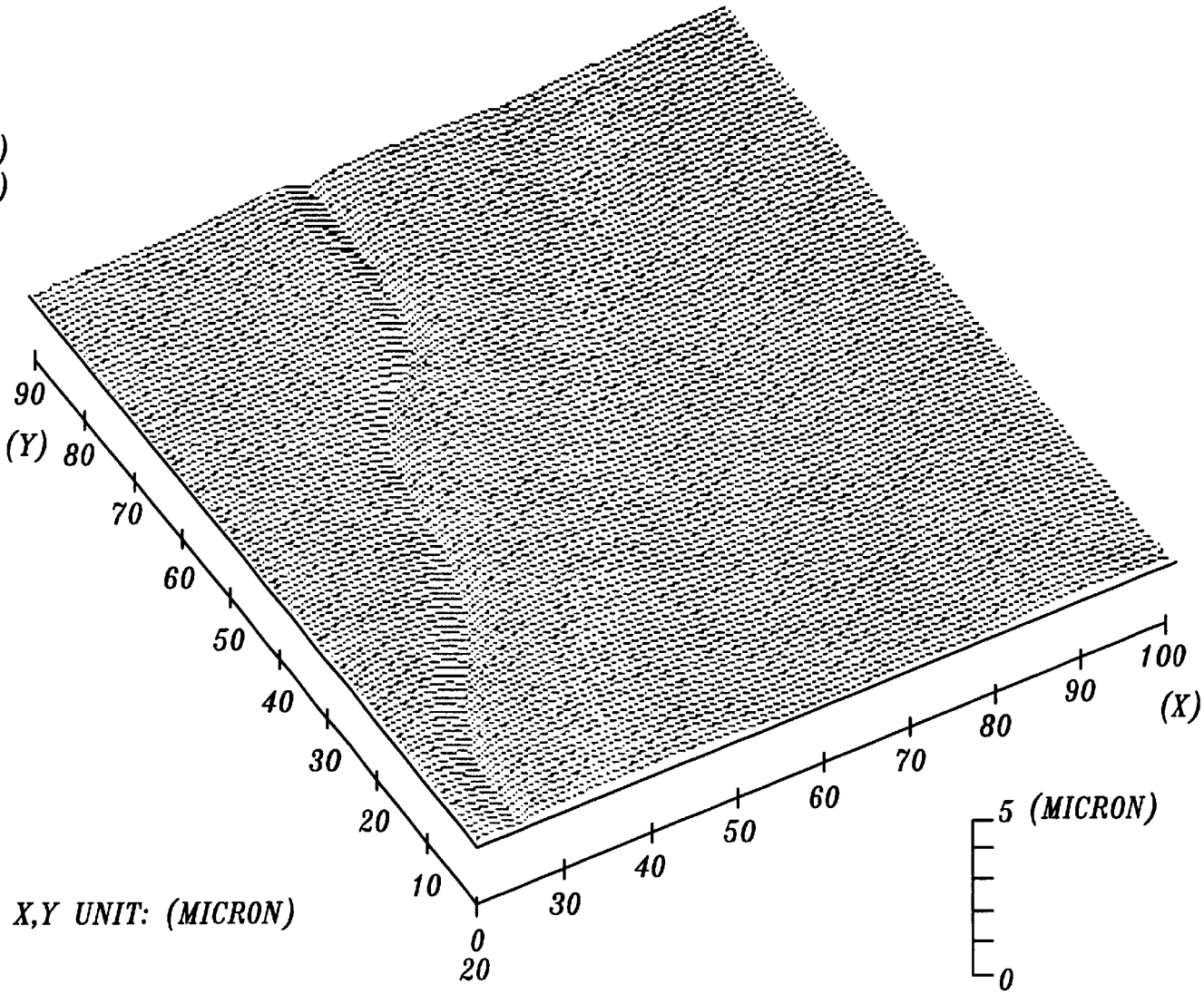
FIG. 4 is a three-dimensional electron microscope photograph of the surface of the electrode after the electrolytic polishing of the electrode, used for the high-pressure discharge lamp according to the first embodiment of the present invention.

FIG. 4 is a three-dimensional electron microscope photograph of the surface of the electrode after the electrolytic polishing of the electrode, used for the high-pressure discharge lamp according to the first embodiment of the present invention. In this case, the center line average roughness Ra is 0.0891 $\mu$m, the ten-point average roughness Rz is 0.342 $\mu$m and the surface area increasing rate is 0.001738%.

Figure 5:
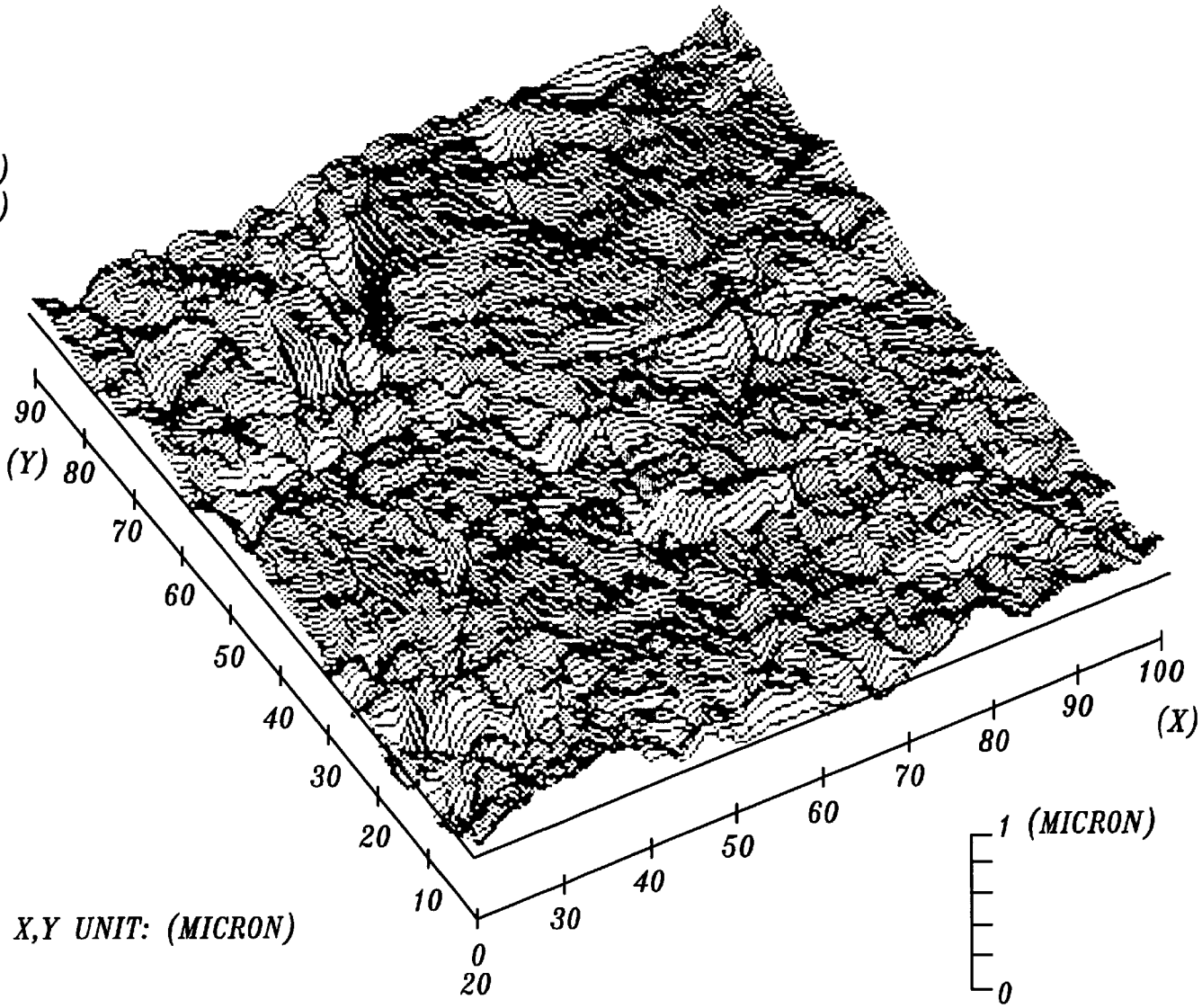
FIG. 5 is a three-dimensional electron microscope photograph of the surface of another electrode before the mechanical polishing of this electrode, used for the high-pressure discharge lamp of the present invention.

FIG. 5 is a three-dimensional electron microscope photograph of the surface of another electrode before the mechanical polishing of the electrode, used for the high-pressure discharge lamp according to the first embodiment of the present invention. In this case, the center line average roughness Ra is 0.43 $\mu$m, the ten-point average roughness Rz is 1.28 $\mu$m and the surface area increasing rate is 0.0303%.

Figure 6:
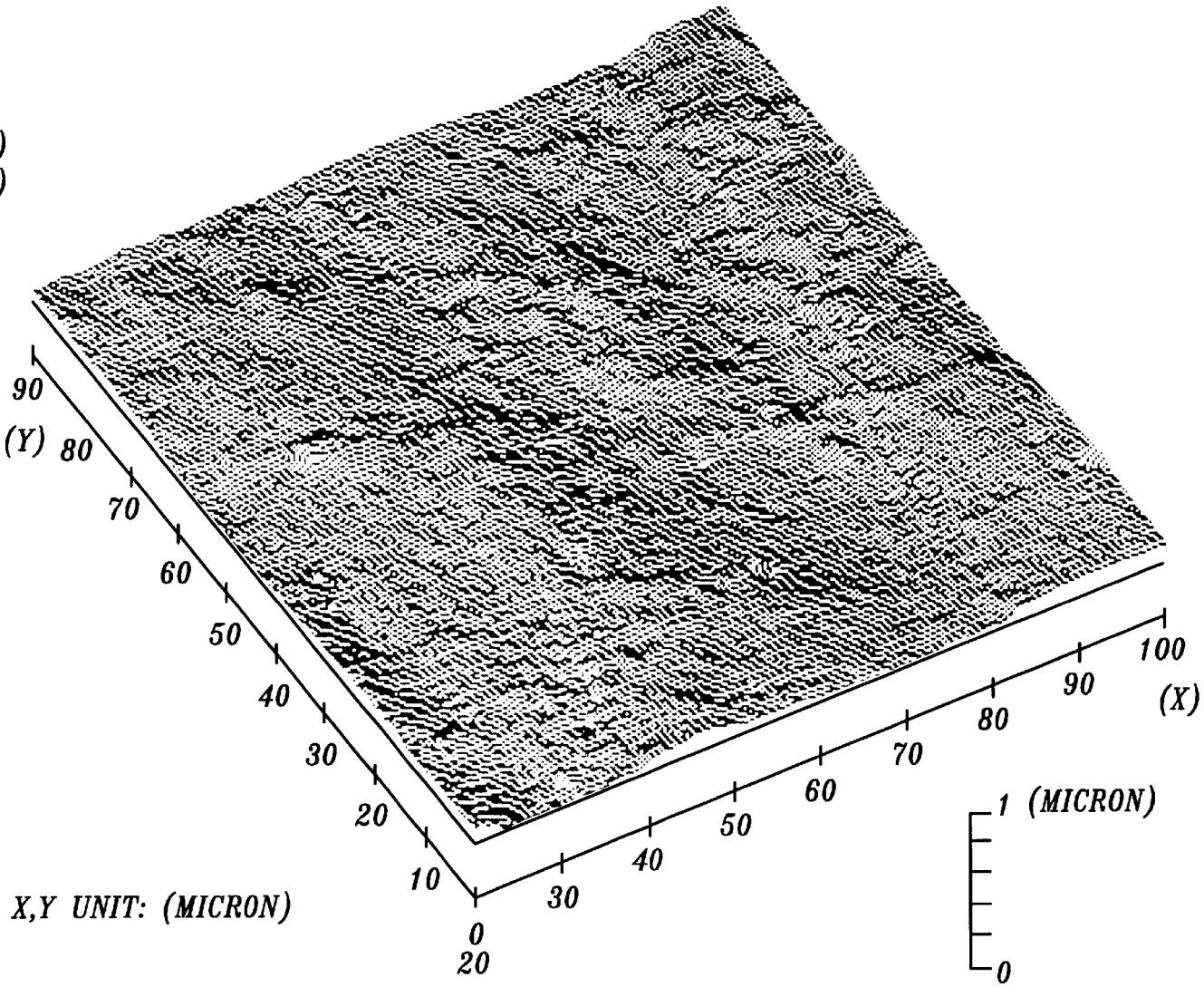
FIG. 6 is a three-dimensional electron microscope photograph of the surface of the above-mentioned another electrode after the mechanical polishing of this electrode used for the high-pressure discharge lamp of the present invention.

FIG. 6 is a three-dimensional electron microscope photograph of the surface of the above-mentioned another electrode after the mechanical polishing of the electrode, used for the high-pressure discharge lamp according to the first embodiment of the present invention. In this case, the center line average roughness Ra is 0.0484 $\mu$m, the ten-point average roughness Rz is 0.119 $\mu$m and the surface area increasing rate is 0.000512%.

It should be noted that the above-described another electrode is an electrode formed by grinding tungsten. Further, in any of the electron microscope photographs of the above-described electrodes, the shooting positions before and after polishing do not match.

As is clear from the comparison between the figures, the electrodes shown in FIGS. 3 and 4 are formed by a wire drawing method, and therefore a mark called die mark is formed in a wire drawing direction, and the mark remains slightly even after the electrolytic polishing. By contrast, as can be seen in FIGS. 5 and 6, the electrodes which are formed by grinding have amorphous surfaces even after mechanical polishing.

As described, the high-pressure discharge lamp which uses the electrode of the present invention, shown in FIGS. 4 and 6 have very good luminous flux maintenance factor.

Next, the seal 4 of the ceramic sealing compound is formed by fuse-solidifying glass frit of an $Al_2O_3$—$SiO_2$—$Dy_2O_3$-based material, and seals air-tightly between the sealing portion 1*b*1 of the end portion of the translucent ceramic discharge container 1 and the sealing portion 2*a* of the feeding conductor 2 to a depth of 5 mm. The sealing portion 2*a* is completely covered by the seal 4 of the ceramic sealing compound.

In the translucent ceramic discharge container 1, the following materials are sealed as discharge media. That is, as halides of light-emitting metals, 2.0 mg of dysprosium iodide $DyI_3$, 0.8 mg of thallium iodide TlI, and 6.0 mg of sodium iodide NaI, are sealed in. As a starting gas, 80 torr of argon Ar, and further as a buffer gas, 10 mg of mercury are sealed in.

Figure 9:
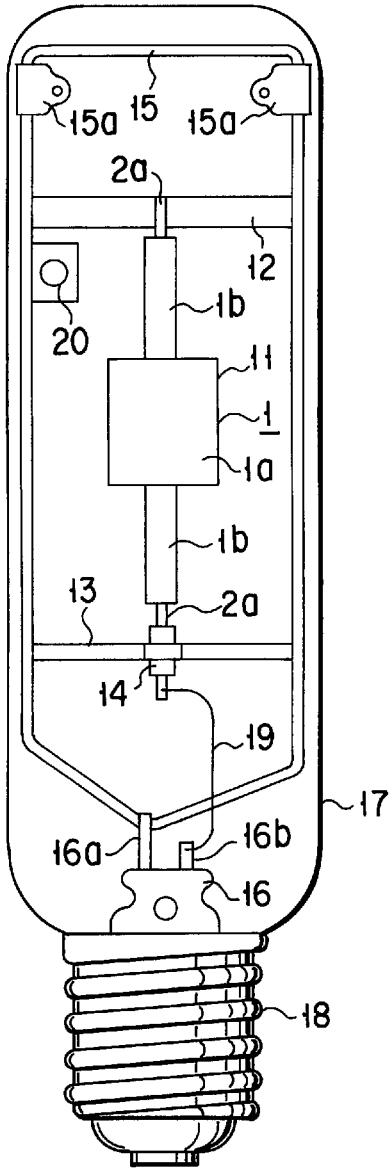
FIG. 9 is a front view of a high-pressure discharge lamp according to the second embodiment of the present invention.

Then, thus obtained high-pressure discharge lamps were housed in outer tubes as in the embodiment shown in FIG. 9, and a lamp power of 150 W was charged to turn them on. In this manner, the luminous flux maintenance factor up to 100 hours of lighting and the luminous efficiency after 100 hours of lighting were obtained together with those of three other comparative examples.

Figure 7:
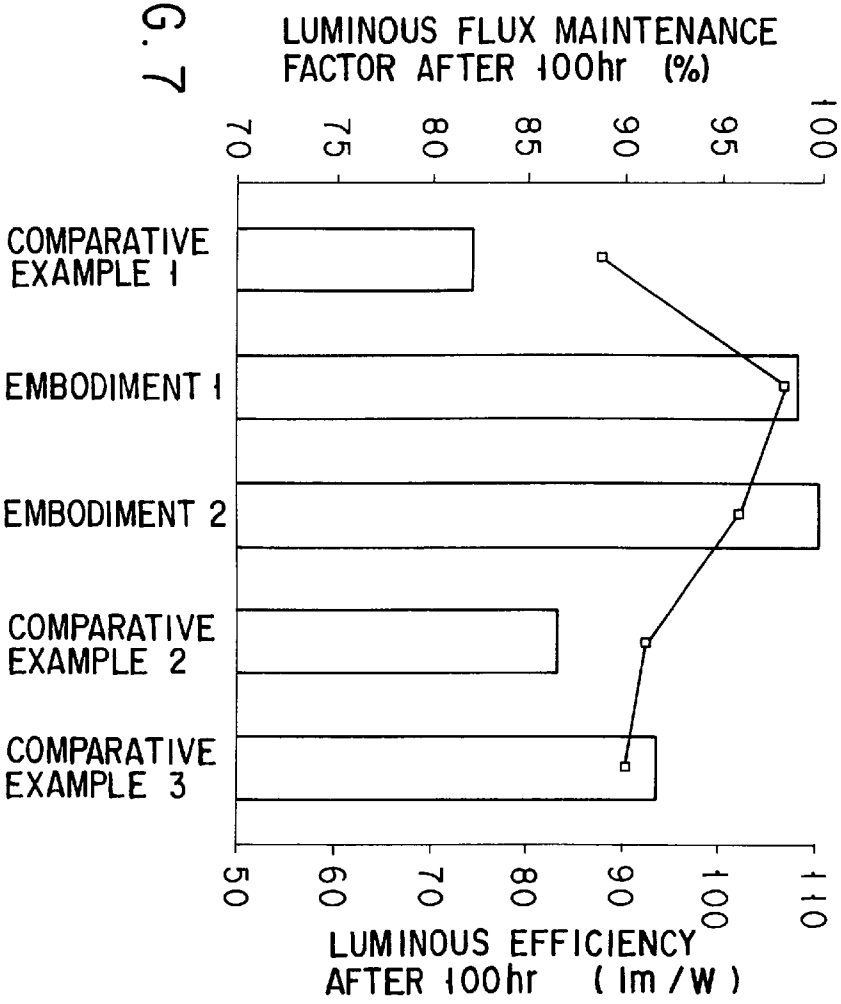
FIG. 7 is a graph indicating a luminous flux maintenance factor up to 100 hours of lighting, of the high-pressure discharge lamp according to the first embodiment of the present invention, and a luminous efficiency after 100 hours of lighting, together with comparative examples.

FIG. 7 is a graph indicating the luminous flux maintenance factor up to 100 hours of lighting and the luminous efficiency after 100 hours of lighting of the high-pressure discharge lamp according to the first embodiment of the present invention, together with those of other comparative examples.

In the figure, the abscissa indicates test lamps, and the ordinate indicates the luminous flux maintenance factor of 0→100 hr (%) on the left side, and the luminous efficiency after 100 hr (1 m/W) on the right side. Further, the abscissa indicates, from the left side, Comparative Example 1, Embodiment 1, Embodiment 2, Comparative Example 2 and Comparative Example 3. Further, the rectangles indicate the luminous flux maintenance factor in the histogram, and the line of the line chart indicates the luminous efficiency.

Embodiment 1 had a luminous flux maintenance factor of 98% for the specification explained in the embodiment 1 of the present invention.

Embodiment 2 had a luminous flux maintenance factor of 99.8% for the specification explained in the embodiment 1 with the addition of 0.2 mg of tin iodide.

Comparative Example 1 is that shown in FIG. 2, and had a luminous flux maintenance factor of 82%.

Comparative Example 2 is the first commercially available lamp, and had a luminous flux maintenance factor of 86.6%.

Comparative Example 3 is the second commercially available lamp, and had a luminous flux maintenance factor of 91.8%.

It should be noted that Comparative Examples 2 and 3 have lamp structures and specifications substantially similar to those of the embodiment.

Figure 8:
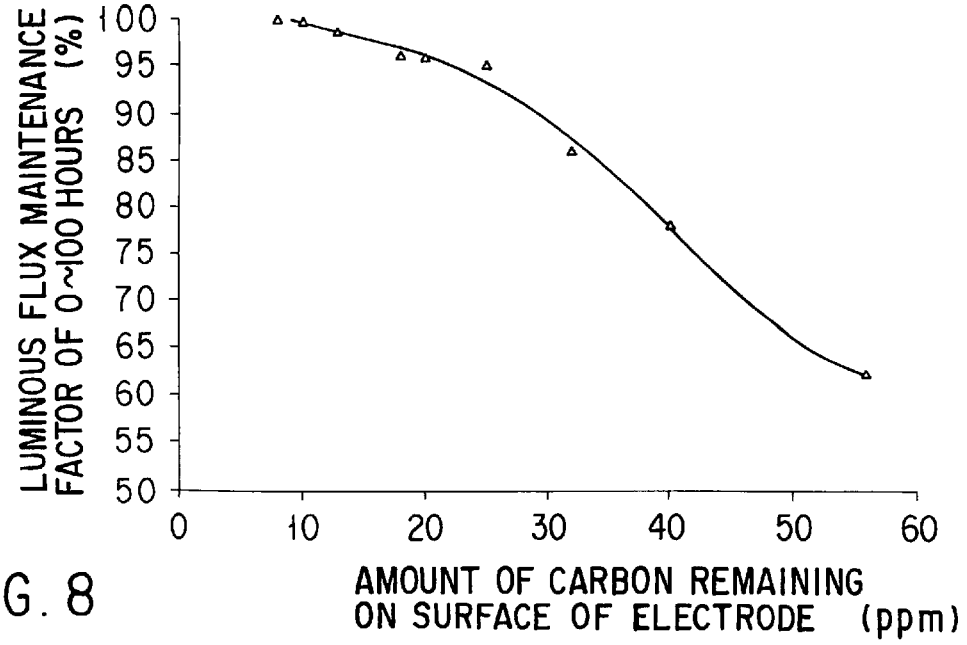
FIG. 8 is a graph indicating a correlation between an amount of carbon remaining on the surface of the electrode of the high-pressure discharge lamp according to the first embodiment of the present invention, and a luminous flux maintenance factor after 100 hours of lighting.

FIG. 8 is a graph indicating the correlation between the amount of carbon remaining on the surface of the electrode of the high-pressure discharge lamp according to the first embodiment of the present invention, and the luminous flux maintenance factor after 100 hours of lighting.

In the figure, the abscissa indicates the amount of carbon (ppm) remaining on the surface of the electrode, and the ordinate indicates the luminous flux maintenance factor (%).

As is clear from the figure, there is a very clear relationship between the amount of carbon remaining on the surface of the electrode and the luminous flux maintenance factor. As the amount of carbon remaining is less, the luminous flux maintenance factor becomes higher, and when the amount of carbon remaining is 25 ppm or less, a luminous flux maintenance factor of about 95% or higher can be obtained.

It should be noted that in the above-described embodiment 1, the amount of carbon remaining was 13 ppm.

Further, in the embodiment 2, it was 10 ppm.

FIG. 9 is a front view of the high-pressure discharge lamp according to the second embodiment of the present invention.

In the figure, a reference numeral 11 denotes a light emitting tube, a numeral 12 denotes a support conductor, a numeral 13 denotes a support band, a numeral 14 denotes an insulation tube, a numeral 15 denotes a conductor frame, a numeral 16 denotes a flare stem, a numeral 17 denotes an outer tube, a numeral 18 denotes a mouth piece and a numeral 19 is a conducting wire.

The light emitting tube 11 is a high-pressure discharge lamp having the same structure as that of the embodiment shown in FIG. 1.

The support band 13 supports the sealing metal portion 2*a* of the light emitting tube 11, which is shown in a lower section in the figure, in an insulation manner, via an insulation tube 14.

The conductor frame 15 is arranged on an outer side of the light emitting tube 11 with an interval, and both end portions of the support conductor 12 and support band 13 are melted to be supported thereon. The upper end section of the frame has elastic contact pieces 15*a* and 15*a*.

The flare stem 16 includes a pair of inner lead wires 16*a* and 16*b*, and the lower end of the conductor frame 15, as shown in the figure, is welded to one inner lead wire 16*a*, so as to support the light emitting tube 11 at a predetermined position. The other inner lead wire 16*b* is connected to the sealing portion of the light emitting tube, which is shown in a lower section of the figure, via a conducting wire 19.

The outer tube 17 is made of a cylindrical T-shaped bulb, and the flare stem 16 is sealed and fixed to the neck portion, which is shown in the lower section of the figure. Thus, the above-described members are housed air-tightly in the container. It should be noted that the contact piece 15*a* of the conductor frame 15 is brought into elastic contact with the inner surface close to the tip end portion of the outer tube 17, and thus the conductor frame 15 is protected from a shock applied from outside, and held at a predetermined position with relative to the outer tube 17.

Further, the inside of the outer tube 17 is exhausted to create a vacuum state.

The mouth piece 18 is fixed to the neck portion of the outer tube 17, and is electrically connected to the pair of the inner lead wires 16*a* and 16*b* of the flare stem 16.

It should be noted that a reference numeral 20 denotes a performance getter. Although it is not shown in the figure, an initial getter is provided in the outer tube 17 in accordance with a necessity.

Figure 10:
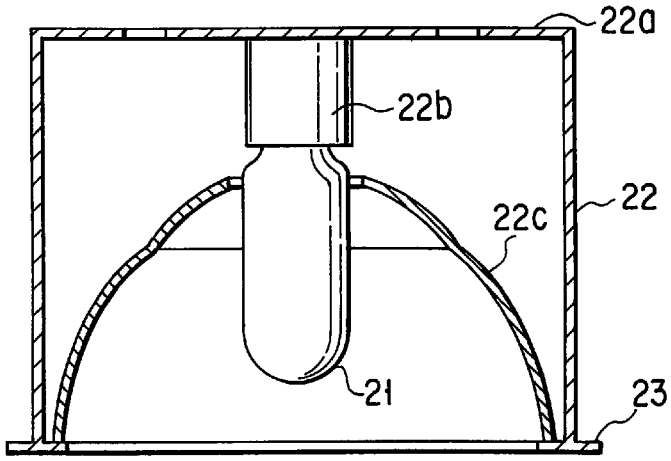
FIG. 10 is a cross sectional view showing a ceiling-embedded type down light of a lighting device according to an embodiment of the present invention.
Figure 11:
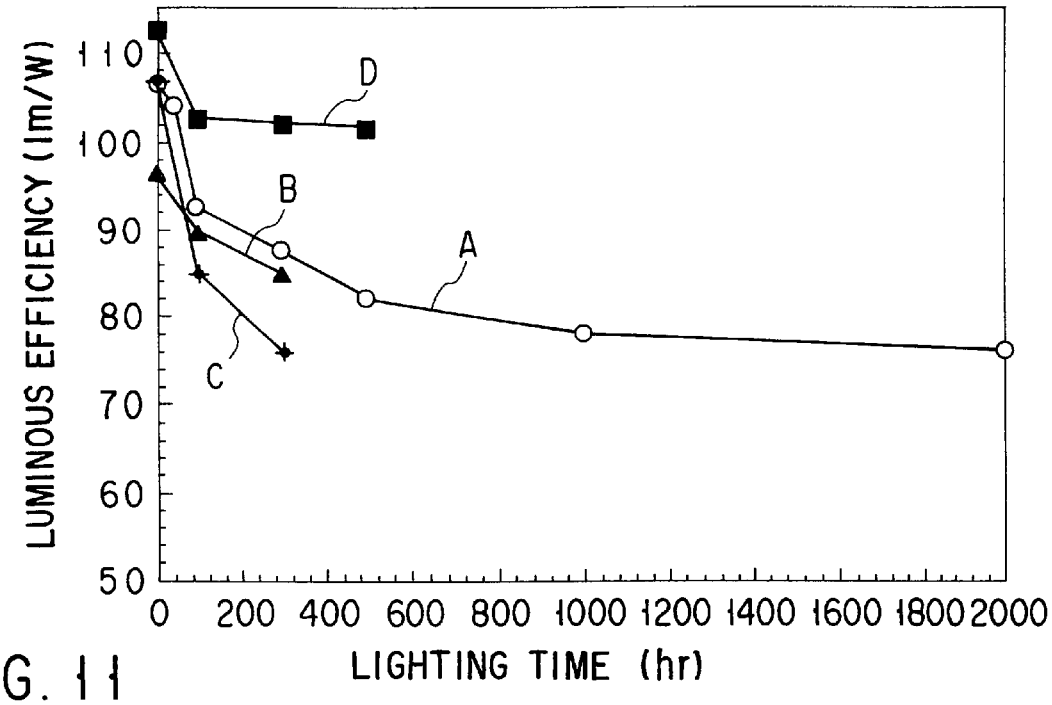
FIG. 11 is a graph indicating lighting time—luminous efficiency characteristics of four types of ceramic discharge lamps which are commercially available and test samples.
Figure 12:
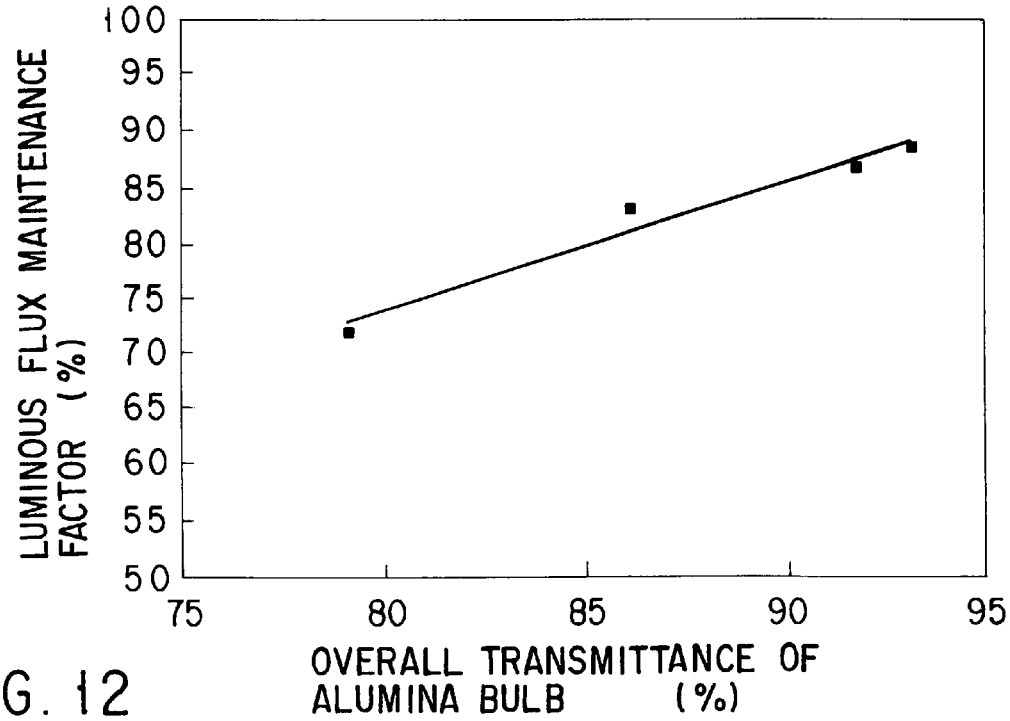
FIG. 12 is a graph indicating a correlation between an overall transmittance and a luminous flux maintenance factor of an alumina bulb which is a ceramic discharge container.

FIG. 10 is a cross sectional view showing a ceiling-embedded type down light of the lighting device according to an embodiment of the present invention.

In the figure, a reference numeral 21 denotes a high-pressure discharge lamp, and a numeral 22 is a down light main body.

The high-pressure discharge lamp 21 has the same structure as that shown in FIG. 9.

The down light main body 22 includes a basic body 22*a,* a socket 22*b,* a reflection plate 22*c* and the like.

Since it is embedded in the ceiling, the basic body 22*a* has at its lower end, a ceiling abut edge 23.

The socket 22*b* is mounted to the basic body 22*a*.

The reflection plate 22*c* is supported by the basis body 22*a,* and surrounds the high-pressure discharge lamp 21 in such a manner that the center of the light emission is located substantially at the center thereof.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A high-pressure discharge lamp comprising:

a light-transmitting air-tight discharge container;

an electrode sealed and fixed in the discharge container, and having an amount of carbon remaining on a surface of the electrode, of 25 ppm or less; and a discharge medium containing at least a halide of a light-emitting metal and sealed in the discharge container.

2. A high-pressure discharge lamp comprising:

a light-transmitting air-tight discharge container having a swelling portion which surrounds a discharge space and end portions having an inner diameter smaller than that of the swelling portion, and connected to both ends of the swelling portion;

a feeding conductor having an anti-halogenation material portion and a sealing portion, the anti-halogenation material portion having a proximal portion connected to a tip end of the sealing portion, and forming a small gap between the anti-halogenation material portion and the inner surface of the end portion;

an electrode provided on the tip end of the anti-halogenation material portion of the feeding conductor to be situated within the swelling portion of the light-transmitting air-tight discharge container, and having an amount of carbon remaining on a surface of the electrode of 25 ppm or less;

a seal of a ceramic sealing compound for sealing a gap between the end portion of the light-transmitting air-tight discharge container and the sealing portion of the feeding conductor; and a discharge medium containing at least a halide of a light-emitting metal and sealed in the discharge container.

3. A high-pressure discharge lamp according to claim 1 or 2, wherein the amount of carbon remaining on the surface of the electrode is 13 ppm or less.

4. A high-pressure discharge lamp according to claim 2, wherein the feeding conductor includes an anti-halogenation material portion made of a tungsten rod or a tungsten wire wound around a tungsten rod.

5. A lighting device comprising:

a lighting device main body; and a high-pressure discharge lamp according to claim 1 or 2, which is mounted onto the lighting device main body.

* * * * *

UNITED STATES PATENT AND TRADEMARK OFFICE

CERTIFICATE OF CORRECTION

PATENT NO. : 6,249,086 B1
DATED : June 19, 2001
INVENTOR(S) : H. Honda et al.

It is certified that error appears in the above-identified patent and that said Letters Patent is hereby corrected as shown below:

Column 20,
Line 6, "of the electrode," should read -- of the electrode --

Signed and Sealed this

Second Day of July, 2002

*Attest:*

*Attesting Officer*

JAMES E. ROGAN
*Director of the United States Patent and Trademark Office*